US006698547B1

(12) United States Patent
Uridel

(10) Patent No.: US 6,698,547 B1
(45) Date of Patent: Mar. 2, 2004

(54) LADDER STANDOFF

(76) Inventor: Loren G. Uridel, 36210 E. Spring Lake Blvd., Fruitland Park, FL (US) 34731

( * ) Notice: Subject to any disclaimer, the term of this patent is extended or adjusted under 35 U.S.C. 154(b) by 0 days.

(21) Appl. No.: 10/188,851

(22) Filed: Jul. 5, 2002

(51) Int. Cl.[7] ..... E06C 7/00
(52) U.S. Cl. ..... 182/107; 182/214
(58) Field of Search ..... 182/107, 214, 182/128; 248/210, 238

(56) References Cited

U.S. PATENT DOCUMENTS

| | | | | | |
|---|---|---|---|---|---|
| 2,908,345 | A | * | 10/1959 | Lund | 182/214 |
| 3,072,218 | A | * | 1/1963 | Peters | 182/214 |
| 4,394,887 | A | * | 7/1983 | Spinks | 182/214 |
| 4,515,242 | A | * | 5/1985 | LaChance | 182/106 |
| 4,593,790 | A | | 6/1986 | Brewer et al. | |
| 4,643,274 | A | * | 2/1987 | Tataseo | 182/106 |
| 4,862,994 | A | * | 9/1989 | Hughes, Sr. | 182/122 |
| 5,622,238 | A | | 4/1997 | Farmer | |
| 5,664,643 | A | | 9/1997 | Taylor, Jr. | |
| 6,244,382 | B1 | * | 6/2001 | Labonte | 182/107 |
| 6,250,424 | B1 | | 6/2001 | Laug | |

FOREIGN PATENT DOCUMENTS

| | | | | |
|---|---|---|---|---|
| GB | 2144168 | A | * 2/1985 | E06C/7/48 |

* cited by examiner

*Primary Examiner*—Alvin Chin-Shue
(74) *Attorney, Agent, or Firm*—Patent & Trademark Services, INC; Joseph H. McGlynn

(57) ABSTRACT

A stabilizing device for ladders which are positioned in a variety of corners, and which has a pair of arms which can be adjusted to fit different corners and which has an adjustable bar to lock the arms in position.

18 Claims, 2 Drawing Sheets

LADDER STANDOFF

BACKGROUND OF THE INVENTION

This invention relates, in general, to ladders, and, in particular, to a means for stabilizing ladders.

DESCRIPTION OF THE PRIOR ART

In the prior art various types of devices have been proposed. For example, U.S. Pat. No. 5,622,238 to Farmer discloses a ladder standoff for inside and outside corners that uses suction cups to engage the corners.

U.S. Pat. No. 4,593,790 to Brewer et al discloses a ladder standoff with pivoting arms to engage corners.

U.S. Pat. No. 6,250,424 to Laug discloses a ladder standoff with telescoping arms to fit outside corners, inside corners or poles.

U.S. Pat. No. 5,664,643 to Taylor, Jr. discloses a ladder standoff with adjustable arms to fit rectangular objects.

SUMMARY OF THE INVENTION

The present invention is directed to a stabilizing device for ladders which are positioned in a variety of corners, and which has a pair of arms which can be adjusted to fit different corners and which has an adjustable bar to lock the arms in position.

It is an object of the present invention to provide a new and improved stabilizing device for a ladder.

It is an object of the present invention to provide a new and improved stabilizing device for a ladder which is easy to use and inexpensive to manufacture.

It is an object of the present invention to provide a new and improved stabilizing device for a ladder which improves ladder safety by adding stability to a ladder when in use.

These and other objects and advantages of the present invention will be fully apparent from the following description, when taken in connection with the annexed drawings.

DESCRIPTION OF THE PREFERRED EMBODIMENT

Figure 1:
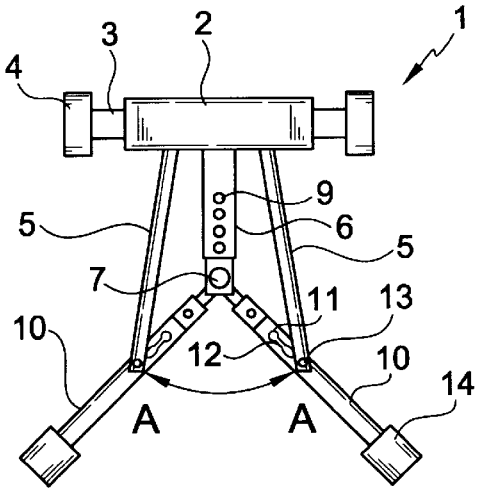
FIG. 1 is a top view of the present invention showing the position for an outside corner.
Figure 4:
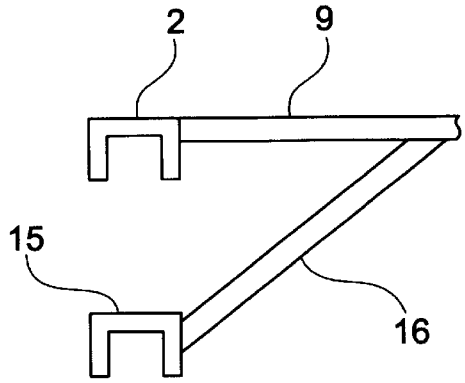
FIG. 4 is a partial side view of the present invention.

Referring now to the drawings in greater detail, FIG. 1 shows a top view of the present invention 1. In FIG. 1 the ladder standoff is positioned to engage an outside corner with the angle between the arms 10, as shown by the arrows AA, at approximately 9°. As shown in FIG. 1, the ladder standoff 1 has a a first U-shaped support 2 (see also FIG. 4) which slides over a rung 3 positioned between the upright supports 4 on a conventional ladder. As shown in FIG. 4, the standoff has a second U-shaped support 15 which slides over a lower rung on the ladder. This will attach the standoff 1 to the rungs of a ladder. The fit between the U-shaped supports 2, 15 should be snug so they cannot rotate with respect to the rungs of the ladder. A brace 16 is attached between the support 15 and the arm 9 in any conventional manner to provide stability between the support 15 and the arm 9.

Figure 2:
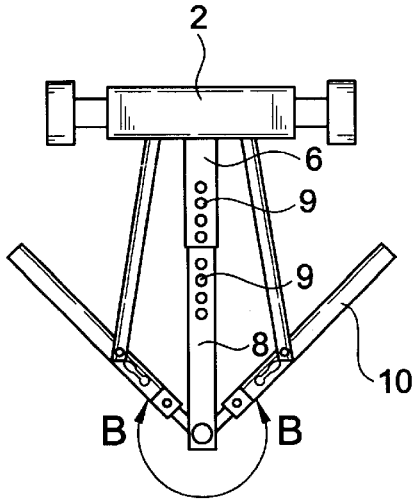
FIG. 2 is a top view of the present invention showing the position for an inside corner.

As shown in FIG. 1, a pair of arms 5 are connected at one end to the support 2 in any conventional manner. The arms 5 are connected at the other end at 13 to a second pair of arms 10. The arms 10 are pivotally connected at 7 to a center arm 6, 8 (see FIG. 2).

Figure 3:
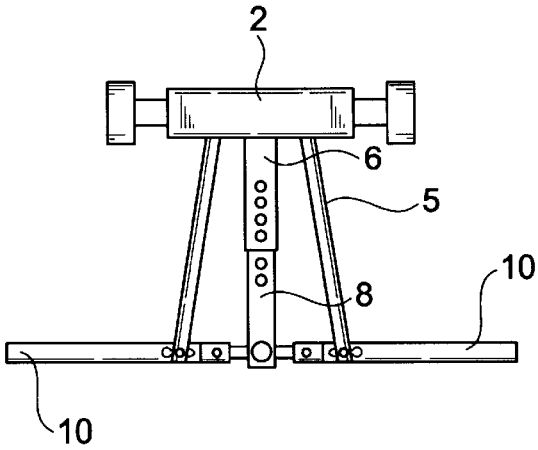
FIG. 3 is a top view of the present invention showing the position for engaging a straight side of an object.

The arms 10 have a series of keyhole slots 11, 12 extending along the length of the arms 10. Each of the arms 5 have a headed pin 13 which can be moved along the series of keyhole slots (compare FIGS. 1, 2 and 3). By moving the pin 13 into different portions of the series of keyhole slots 11, 12 the arms 10 can be pivoted around pivot 7 so the arms can assume the position shown in FIG. 1, FIG. 2 or the position shown in FIG. 3. The position of the arms 10 shown in FIG. 1 allows the ladder to be positioned against an outside corner. The position of the arms 10 shown in FIG. 2 allows the ladder to be positioned against an inside corner. The position of the arms 10 shown in FIG. 3 allows the ladder to be positioned against a straight surface such as the side of a house.

The ends of the arms 10 can be fitted with protective pads or caps 14 to prevent the arms from damaging the surface they are placed against. The pads or caps are preferably extruded cylinders of polyethylene foam which can be replaced if wear on the pads becomes excessive.

The center arm is comprised of two telescoping arms 6, 8. Each arm 6, 8 has a plurality of apertures 9 along their lengths. In order to adjust the length of the arms 6, 8, apertures in each arm would be aligned and a pin (not shown) would be inserted into the aligned apertures to secure the arms in position.

Figure 5:
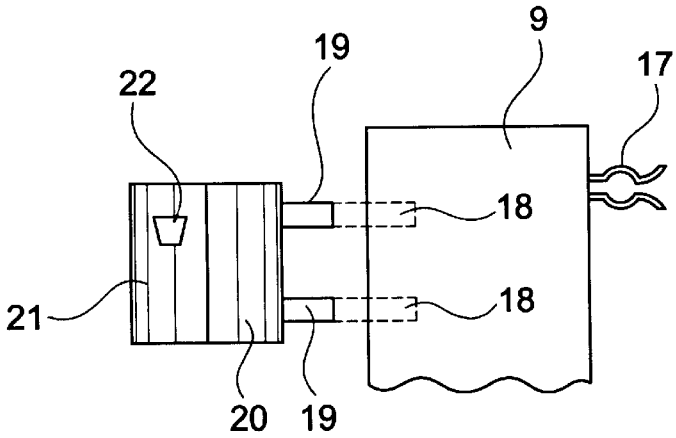
FIG. 5 is a top view of the present invention showing, the tool rest.
Figure 6:
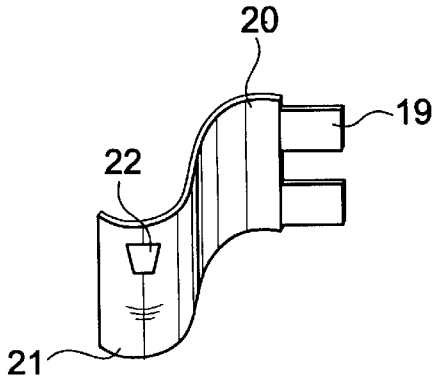
FIG. 6 is a perspective view of one of the tool rests of the present invention.

As shown in FIGS. 5 and 6, tool rests can be attached to the ladder standoff to hold a variety of tools that the user may need. A tool rest for a caulk gun is shown having a pair of tabs 19 which slide into slots 18 in arm 9. It should be noted that while the tool rest is shown as being secured to arm 9, it could be secured to one of the other arms as well. Also, a plurality of the tool rests could be used which are all secured to one of the arms or to different arms. The tool rest has a first surface 20 (see FIG. 6) to which the tabs 19 are secured, and a circular surface 21 which will accept a standard caulking gun. The triangular aperture 22 in surface 21 will accept the handle of the caulk gun in a secure position should the user want to move the ladder without unloading the tools first.

The arm also has a plurality of spring clips 17 (only one of which is shown in FIG. 5 for purposes of clarity. The user can snap tools into the clips 17 in order to hold the tools in a convenient position when on the ladder.

Although the Ladder Standoff and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A stabilizing device for a ladder, said stabilizing device comprising:

means for securing said stabilizing device to a first rung of a ladder, second means for securing said stabilizing device to a second rung of said ladder, a first pair of arms, each of said first pair of arms being secured at one end to said means for securing said stabilizing device to a first rung of a ladder, each of said first pair of arms being secured at another end to individual arms of a second pair of arms, a center arm secured at one end to said means for securing said stabilizing device to a first rung of a ladder, and each of said second pair of arms having a first end and a second end, said first end of each of said second pair of arms being pivotally secured to a second end of said center arm, and said another end of said first pair of arms being detachably secured to said second pair of arms at a plurality of locations between said first end and said second end of said second pair of arms.

2. The stabilizing device as claimed in claim 1, wherein said means for securing said stabilizing device to a first rung of a ladder is a U-shaped support.

3. The stabilizing device as claimed in claim 1, wherein said second means for securing said stabilizing device to a second rung of a ladder is a U-shaped support.

4. The stabilizing device as claimed in claim 1, wherein said center arm comprises a pair of arms, and means for adjusting said pair of arms to different lengths.

5. The stabilizing device as claimed in claim 1, wherein said first pair of arms and said second pair of arms have cooperating means for adjusting an angular relationship between said second pair of arms.

6. The stabilizing device as claimed in claim 5, wherein said cooperating means for adjusting an angular relationship between said second pair of arms comprises:

each of said second pair of arms has a series of keyhole slots extending along a length of said second pair of arms, and each of said first pair of arms has a pin, said pin engaging said keyhole slots to position said first pair of arms with respect to said second pair of arms.

7. The stabilizing device as claimed in claim 1, wherein said stabilizing device has a tool rest secured thereto, said tool rest having a first surface and a second surface, said first surface having means for securing said tool rest to said stabilizing device, said second surface having means for securing a tool thereto.

8. The stabilizing device as claimed in claim 7 wherein said means for securing said tool rest to said stabilizing device is a pair of tabs.

9. The stabilizing device as claimed in claim 8, wherein said stabilizing device has a pair of slots for receiving said pair of tabs.

10. The stabilizing device as claimed in claim 7, wherein said means for securing a tool to said second surface is a circular surface.

11. The stabilizing device as claimed in claim 7 wherein said means for securing a tool to said second surface is an aperture extending through said second surface.

12. The stabilizing device as claimed in claim 7, wherein said means for securing a tool to said second surface is a circular surface and an aperture extending through said second surface.

13. The stabilizing device as claimed in claim 1, wherein said stabilizing device has a second tool rest secured thereto, said second tool rest comprising at least one spring clip.

14. The stabilizing device as claimed in claim 1, wherein said center arm comprises two parts, a first part which is permanently secured to said means for securing said stabilizing device to a first rung of a ladder, and a second part which telescopes with said first part, and means for securing said first part with respect to said second part at a plurality of locations.

15. The stabilizing device as claimed in claim 1, wherein said second pair of arms have a first side which is adjacent said means for securing said stabilizing device to a first rung of a ladder, and said second pair of arms have a second side which is remote from said means for securing said stabilizing device to a first rung of a ladder, and said second pair of arms movable from a first position to a second position, said second side of said second pair of arms forming a plurality of angles with each other as said second pair of arms are moved from said first position to said second position.

16. The stabilizing device as claimed in claim 15, wherein said plurality of angles vary from an acute angle to an obtuse angle as said second pair of arms are moved from said first position to said second position.

17. The stabilizing device as claimed in claim 15, wherein said first pair of arms and said second pair of arms have cooperating means for securing said second pair of arms in said plurality of angles.

18. The stabilizing device as claimed in claim 17, wherein said means for securing said second pair of arms in said plurality of angles comprises:

each of said second pair of arms has a series of keyhole slots extending along said second pair of arms, and each of said first pair of arms has a projection, said projection engaging said keyhole slots to vary the angle between said second pair of arms.

* * * * *